US006158779A

United States Patent [19]

Petrick

[11] Patent Number: 6,158,779

[45] Date of Patent: Dec. 12, 2000

[54] COMBINED AIRBILL/FEDERAL DRUG TESTING CUSTODY AND CONTROL FORM (CCF)

[75] Inventor: Kathryn D. Petrick, Chanhassen, Minn.

[73] Assignee: Moore North America, Inc., Grand Island, N.Y.

[21] Appl. No.: 09/286,243

[22] Filed: Apr. 5, 1999

[51] Int. Cl.[7] ..... B42D 15/00

[52] U.S. Cl. ..... 283/81; 283/79; 283/80; 283/81; 283/101; 283/900; 462/2; 462/54; 462/64

[58] Field of Search ..... 283/79, 80, 81, 283/101, 900; 462/2, 64, 54

[56] References Cited

U.S. PATENT DOCUMENTS

| | | | |
|---|---|---|---|
| 5,071,167 | 12/1991 | O'Brien . | |
| 5,238,272 | 8/1993 | Taylor . | |
| 5,240,456 | 8/1993 | Ochiai . | |
| 5,397,052 | 3/1995 | Walz . | |
| 5,413,383 | 5/1995 | Laurash et al. . | |
| 5,421,778 | 6/1995 | Kouramanis | 283/79 |
| 5,520,990 | 5/1996 | Rotermund . | |
| 5,573,277 | 11/1996 | Petkovsek . | |
| 5,618,064 | 4/1997 | Main | 283/80 |
| 5,626,370 | 5/1997 | Petkovsek . | |
| 5,697,648 | 12/1997 | Petkovsek . | |
| 5,704,650 | 1/1998 | Laurash et al. . | |
| 5,752,723 | 5/1998 | Robertson | 283/67 |
| 5,855,395 | 1/1999 | Foote et al. | 283/67 |
| 5,967,558 | 10/1999 | Petkovsek | 283/61 |

*Primary Examiner*—Willmon Fridie, Jr.
*Assistant Examiner*—Daniel Phan
*Attorney, Agent, or Firm*—Simpson, Simpson & Snyder, L.L.P.

[57] ABSTRACT

A multi-ply business form, comprising a chain of custody form having a first section for recording information required by federal drug testing regulations, and a second section containing one or more adhesive labels for labeling containers of body fluid specimens to be tested, and, an airbill form detachably secured to the chain of custody form, the airbill form containing a first part for recording information about sender and recipient of the container, and a second part containing an adhesive label containing information about sender and recipient, the adhesive label arranged to be secured to the container.

16 Claims, 8 Drawing Sheets

FIG. 1
PRIOR ART
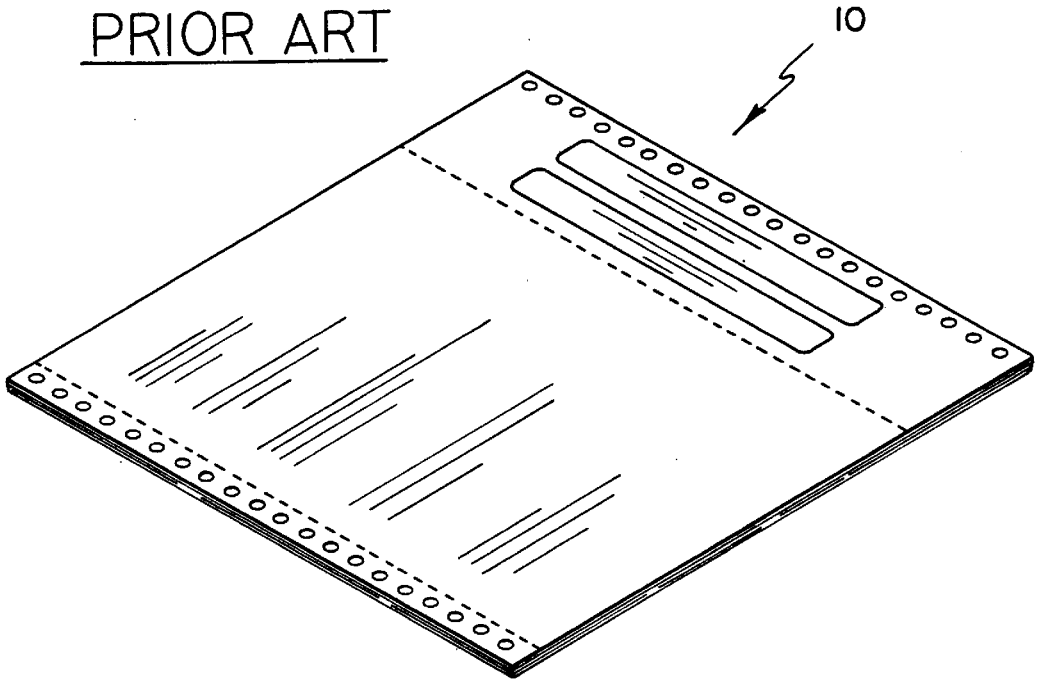
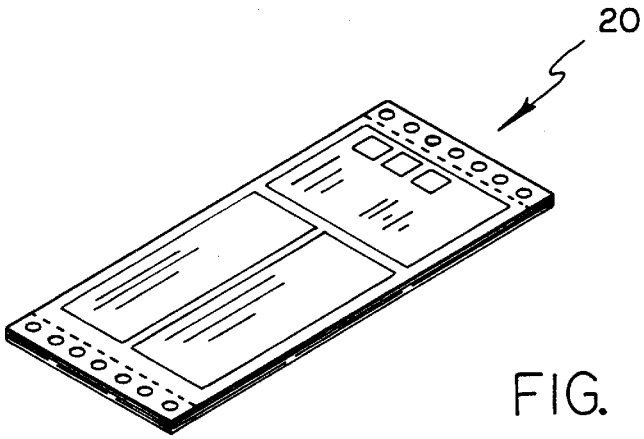
FIG. 2
PRIOR ART

FIG. 9
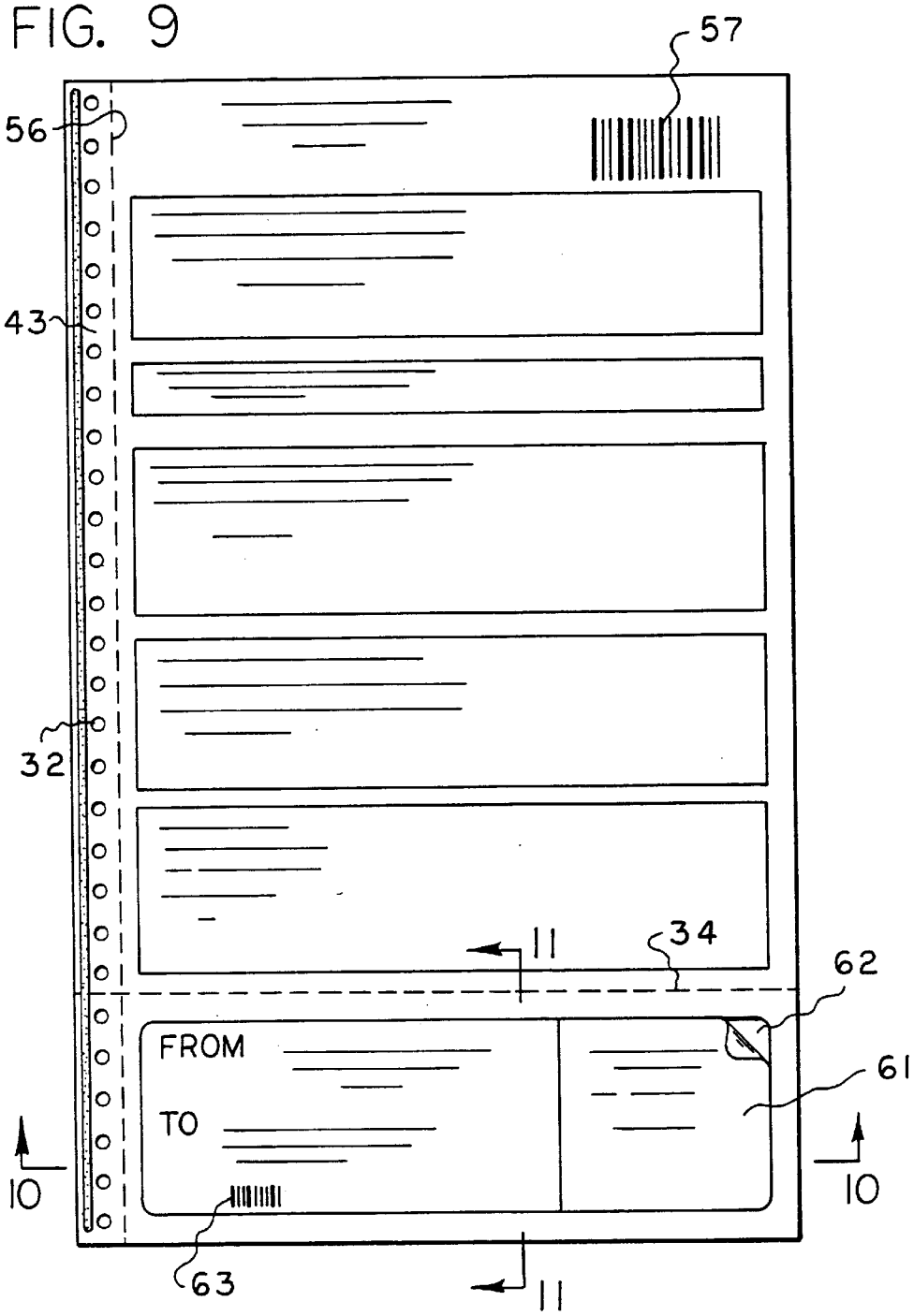
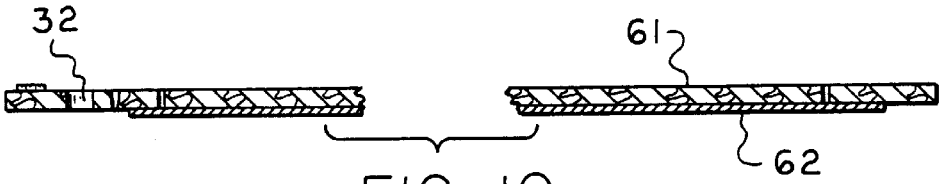
FIG. 10

FIG. 11
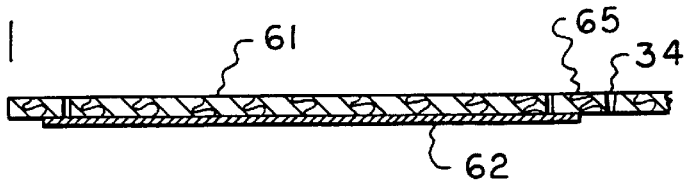
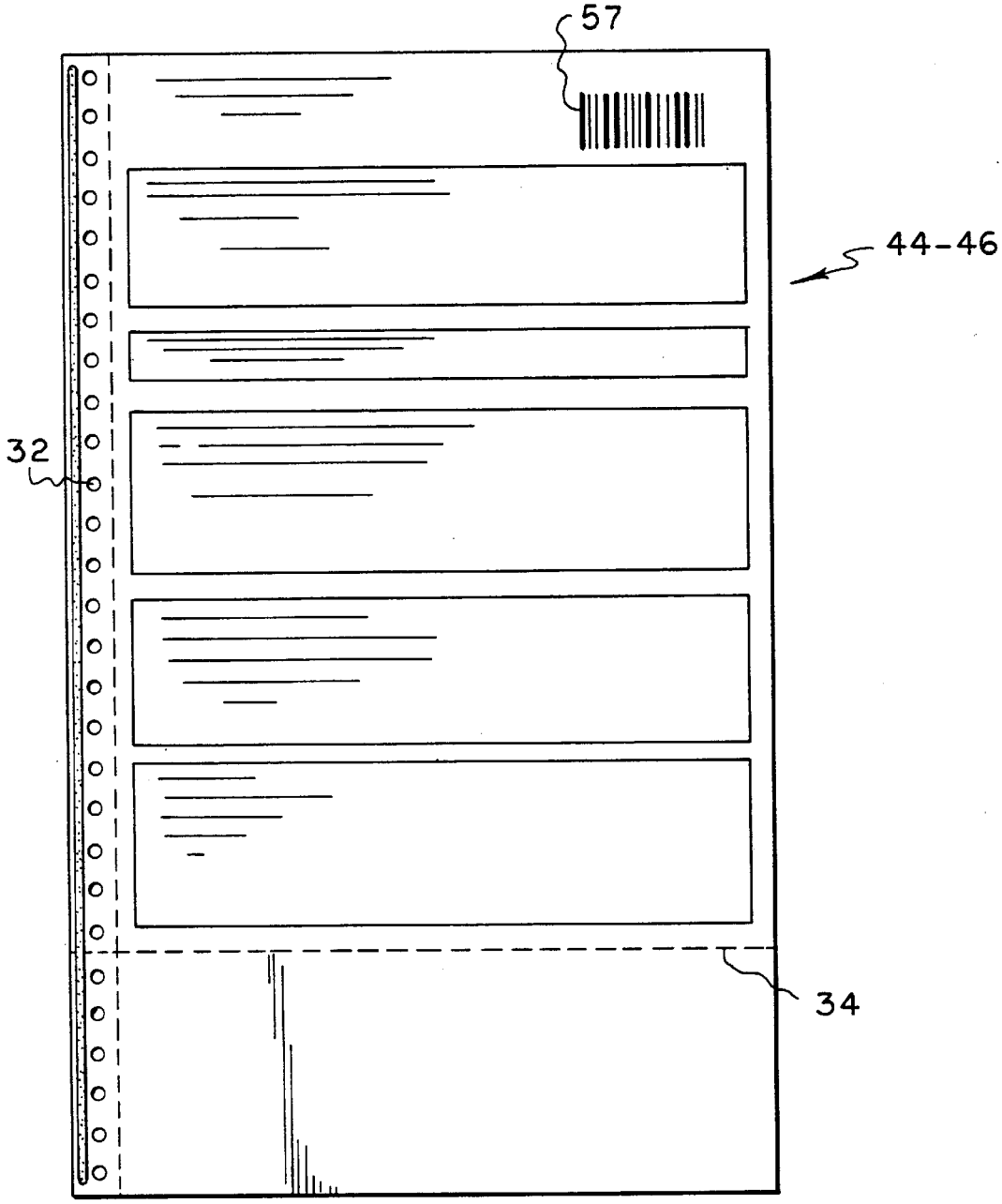
FIG. 12

COMBINED AIRBILL/FEDERAL DRUG TESTING CUSTODY AND CONTROL FORM (CCF)

FIELD OF THE INVENTION

This invention relates generally to business forms and, more particularly, to a combined airbill and federal drug testing custody and control form (CCF).

BACKGROUND OF THE INVENTION

The Department of Transportation's (DOT) operating administrations (Federal Aviation Administration, Federal Highway Administration, Federal Railroad Administration, United States Coast Guard, Federal Transit Administration, and Research and Special Programs Administration) have issued regulations requiring anti-drug programs in the aviation, highway, maritime, mass transit, and pipeline industries.

The DOT operating administrations' rules require that employers conduct drug testing according to provisions of 49 CFR Part 40, "Procedures for Transportation Workplace Drug Testing Programs," Final Rule, published in the Federal Register on Dec. 1, 1989 (54 FR 49854), revised on Feb. 15, 1994 as "Procedures for Transportation Workplace Drug and Alcohol Testing Programs" (59 FR 7340) and amended on Aug. 19, 1994 (59 FR 42996). The procedures in 49 CFR 40 are based on the Department of Health and Human Services' "Mandatory Guidelines for Federal Workplace Drug Testing Programs," published in the Federal Register on Apr. 11, 1988 (53 FR 11970) and revised on Jun. 9, 1994 (59 FR 29908). All of the above-cited rules and regulations are incorporated herein by reference.

The procedures for collection of urine under these rules are very specific and must be followed whenever a DOT required urine collection (for a drug test) is performed. The only exception is the Federal Railroad Administration's Post-Accident Toxicological Testing Program in the collector will be provided specific instructions and a testing kit by the railroad representative. These procedures (including the mandatory DOT custody and control form) apply only to DOT required testing. While employers can use these procedures for testing under employer or state authority, they are not required by Federal regulations to do so.

All urine specimens taken in compliance with DOT rules must be collected while maintaining chain of custody. Chain of custody is the term used to describe the process of documenting the handling of a specimen from the time a donor gives the specimen to the collector, during the testing at the laboratory, and until the results are reported by the laboratory. For specimens collected under Federal regulations, an Office of Management and Budget (OMB) approved Custody and Control Form (CCF) must be used to document the collection of a specimen. A representative prior art form is shown in perspective view in FIG. 1, although the CCF may be configured and manufactured in a variety of ways as long as it meets certain legal requirements and is approved by the OMB. The OMB-approved CCF can be supplied by a number of different sources (e.g., laboratories, collectors, Medical Review Officers (MROs)) without being modified; however, it is usually provided by the laboratory. There is a space provided at the top of the form to allow the laboratory to preprint its own name and address. If the form does not have the preprinted laboratory name and address, the collector must ensure that the name and address of the laboratory receiving the specimen are printed on the top of the form. If the CCF uses a barcode for the specimen identification number, there must be a human readable number associated with the barcode. The OMB number must appear on each copy of the CCF.

Pursuant to regulations, the CCF consists of the following seven copies with the color of each copy noted in parentheses:

Copy 1. Original-Must Accompany Specimen to Laboratory (White)

Copy 2. Second Original-Must Accompany Specimen to Laboratory (White)

Copy 3. Split Specimen-Must Accompany Split Specimen to Laboratory (White)

Copy 4. Medical Review Officer Copy (Pink)

Copy 5. Donor Copy (Green)

Copy 6. Collector Copy (Yellow)

Copy 7. Employer Copy (Blue)

Note: Copy 3 is discarded for single specimen collection. The reverse side of Copy 7 gives instructions on completing the CCF. Representative instructions, reprinted from an actual CCF form, are as follows:

INSTRUCTION FOR COMPLETING DRUG TESTING CUSTODY AND CONTROL FORM

The following instructions are in accordance with procedures established by the Department of Health and Human Services and the Department of Transportation mandatory guidelines for federal and transportation workplace drug testing programs. NOTE: Use ballpoint pen, press hard, and check all copies for legibility.

STEP 1. If the information in STEP 1 has not been completed, collector (not donor) completes STEP 1 (A–E).

NOTE: Donor refusal to provide SSN or Employee I.D. number must be annotated in STEP 5, collector's REMARKS section.

STEP 2. Upon receiving specimen from donor, check specimen temperature. This must be accomplished within 4 minutes.

Check block marked "Yes" if temperature is within range.

If specimen temperature is not within range, check block marked "No" and record specimen temperature.

STEP 3. FOR SPLIT SPECIMEN COLLECTION ONLY.

Secure caps on both specimen bottles and affix specimen bottle seal labeled A over the cap and down the sides of the primary specimen (bottle containing at least 30 ml of urine).

Affix specimen bottle seal labeled B (split) on the split specimen (bottle containing at least 15 ml of urine) in same manner.

Record date on both specimen bottle seals.

FOR SINGLE SPECIMEN COLLECTION ONLY.

Secure cap on specimen bottle (containing at least 30 ml of urine) and affix specimen bottle seal labeled A over the cap and down the sides of the specimen bottle.

Record date on specimen bottle seal.

Instruct donor to initial the specimen bottle seal.

STEP 4. Turn to Copy 4 (pink page). STEP 4.

Instruct donor to complete STEP 4.

Ensure donor provides his/her daytime and evening phone number and date of birth.

Instruct donor to read certification statement. Ensure donor prints his/her name and signs and dates the certification statement.

NOTE: Donor refusal to sign must be annotated in STEP 5, collector's remarks section.

Upon completion, check donor entries, return to Copy 1.

STEP 5. After returning to Copy 1, go to STEP 5.

Complete the name and address of the facility at which the collection is taking place.

List a business telephone number where collector can be reached.

Place a check in the box indicating whether or not a split specimen was collected.

Record any unusual occurrences concerning the collection (e.g. donor refusal to provide information/sign certification statement, specimen collected under direct observation, suspected adulteration) in the remarks section.

Collector completes collection certification section by printing and signing his/her name, recording the date and time of collection. Be sure to circle A.M. or P.M.

STEP 6. CHAIN OF CUSTODY SECTION

NOTE: Each time the specimen is handled, transferred, or placed into storage prior to being packaged for shipment, every individual must be identified (including a direct observer, if required) and the date and purpose of change recorded. The following instructions pertain to a collection in which the donor provides a specimen directly to the collector who seals, packages, and ships the specimen to the laboratory.

Record date of collection.

In the "Specimen Received By" column, sign and print your name indicating that you have received the specimen from the donor.

The "Purpose of Change" entry in the next column is pre-printed (Provide Specimen for Testing) and explains the transfer of the specimen from the donor to the collector.

On the next line, record the date the specimen was released by you.

Complete the "Specimen Released By" block by signing and printing your name.

If you are preparing the specimen for shipment to the laboratory complete the "Specimen Received By" block by printing the carrier or shipment provider name only. (See Example)

Complete the "Purpose of Change" block explaining the transfer of the specimen from the collector to the carrier or shipment provider (e.g. Ship Specimen to Lab).

| DATE MO. DAY YR. | SPECIMEN RELEASED BY | SPECIMEN RECEIVED BY | PURPOSE OF CHANGE |
|---|---|---|---|
| / / | DONOR-NO SIGNATURE | Signature<br>Name | PROVIDE SPECIMEN FOR TESTING |
| / / | Signature<br>Name | Signature<br>Name | |
| / / | Signature<br>Name | Signature<br>Name | |
| / / | Signature<br>Name | Signature<br>Name | |

Completing the Collection Process

Upon completing Step 6, give donor her/her copy, Copy 5, (green page) of the Drug Testing Custody and Control Form.

Donor may leave the collection site at this point.

If a split specimen collection was performed, place both specimen bottles and Copies 1, 2 and 3 of the Drug Testing Custody and Control Form in the shipping container.

If a single collection was performed, place the specimen bottle and Copies 1 and 2 of the Drug Testing Custody and Control Form in the shipping container. Discard Copy 3

Secure the shipping container. On the shipping container seal, record your initials and the date.

Send Copy 4 (pink page) directly to the Medical Review Officer. Do not send to laboratory.

Retain Copy 6 (yellow page) for your records.

Forward Copy 7 (blue page) to the employer. Do not send to laboratory.

The urine specimens are placed in a sealed, tamper-evident container for shipment to the testing laboratory. After the shipping container/package is sealed, there is no requirement for couriers, express carriers, or Postal Service personnel to document chain of custody for the specimens during transit because they do not have access to the specimen/split specimens or the CCF. Chain of custody annotations resume when the shipping container/package is opened at the laboratory and an individual has access to the specimen/split specimens and the CCF.

In view of the time, effort and expense involved in obtaining and documenting the chain of custody of the specimen, it is obviously critically important that the specimens be safely transported to the laboratory. The regulations don't specify the method of delivery to be used, but most employers prefer a speedy, reliable, documented delivery service. It is preferable to use a delivery method that permits tracking of the package and proof of delivery. While the United States Postal Service provides suitable delivery methods, so also do several private or publicly traded companies, including, but not limited to Airborne Express, United Parcel Service, DHL, Purolator, RPS, and Federal Express.

Common to most, if not all, express delivery services is the use of an airbill. While airbills are made in many shapes, sizes and configurations, a representative airbill used by Airborne Express is illustrated in perspective view in FIG. 2. Every package shipped by Airborne Express must have an airbill.

The prior art airbill shown in FIG. 2 has three parts. The first part (top layer) stays with the sender. Impressions made on the first part are transferred to the second and third parts by well-known carbonless copy techniques. The second part (middle layer) is signed at the delivery point and is sent to Airborne Express headquarters for billing purposes. The third part is an adhesive label secured to a liner. The label includes a bar code used at each point in the shipping/delivery process. The airbill number is entered into a hand-held computer via a barcode on the label. A pickup, drop location and account number is also imprinted on the label.

The bar code on the label is swiped (decoded) at each of five shipping points:

a. Pick-up b. Outbound—Origin (where the package came from)

c. Inbound—Destination (where the package is going to)

d. Out for Delivery—loaded on trucks at destination terminal for delivery e. Proof of Delivery—name of person signing for package is entered Airborne and other shippers each use a variety of different types of airbills depending on what is being shipped or who the shipper is. For example, hazardous materials require special labeling and handling instructions to meet DOT regulations. Custom airbills may be used for companies who ship large volumes and need to perform internal tracking.

Despite the concurrent use of chain of custody forms and airbills for every federally regulated DOT drug test conducted in the United States (except where the specimens are hand-delivered to the laboratory), heretofore no combined CCF/airbill has been available. There has been a longfelt need, then, for a combined chain of custody/airbill form for use in documenting and shipping specimens for DOT drug testing.

SUMMARY OF THE INVENTION

The present invention broadly comprises a multi-ply business form, comprising a chain of custody form having a first section for recording information required by federal drug testing regulations, and a second section containing one or more adhesive labels for labeling containers of body fluid specimens to be tested, and, an airbill form detachably secured to the chain of custody form, the airbill form containing a first part for recording information about sender and recipient of the container, and a second part containing an adhesive label containing information about sender and recipient, the adhesive label arranged to be secured to the container.

A general object of the invention is to provide a multi-ply business form that complies with federal regulations relating to chain of custody of a specimen to be drug tested and also functions as a conventional airbill for shipping of a container for the specimen.

Another object is to reduce multiple form manufacturing processes to a single process.

A further object is to reduce multiple shipping legs to one shipping leg, and to track a single package number rather than multiple package numbers.

Still another object to provide a multi-ply business form that enables a single tracking system to be used to track a specimen for drug testing from collection to delivery to a laboratory for testing.

These and other objects, advantages and features of the present invention will become readily apparent to those having ordinary skill in the art from a reading of the following detailed description of the invention in view of the drawings and appended claims.

BRIEF DESCRIPTION OF THE DRAWINGS

FIG. 1 is a perspective view of a prior art chain of custody form (CCF);

FIG. 2 is a perspective view of a prior art airbill;

FIG. 9 is a plan view of the third ply of the form shown in FIGS. 3 and 5;

FIG. 10 is a cross-sectional view of the third ply of the form, taken generally along line 10—10 in FIG. 9;

FIG. 11 is a fragmentary cross-sectional view of the third ply of the form, taken generally along line 11—11 in FIG. 9;

FIG. 12 is a plan view of the fourth, fifth and sixth plies of the form shown in FIGS. 3 and 5; and, FIG. 13 is a plan view of the seventh or bottom ply of the form shown in FIGS. 3 and 5.

DETAILED DESCRIPTION OF THE INVENTION

It should be appreciated at the outset that the present invention relates to a combined federal drug testing chain of custody form and a conventional airbill. Although a preferred embodiment of the invention is described and illustrated herein, it should be obvious to one having ordinary skill in the art that the combined form could be manufactured in a variety of ways, and take form in a variety of configurations. For example, the label portions of both the chain of custody portion and the airbill portion could be placed on a single liner ply, or could be placed on "blow on" liners affixed to different plies. While the CCF requires seven plies or copies under federal law, the airbill may require fewer plies. While a preferred embodiment is disclosed that uses the top three plies for both the CCF and airbill, but uses the bottom four plies only for the CCF, obviously this configuration is not critical to the invention. For example, the airbill may comprise more or less than three plies, and these could be located anywhere in the form.

Adverting now to the drawings, and as described previously, FIG. 1 illustrates, in perspective, prior art federal drug testing chain of custody form 10. Form 10 can take many shapes and configurations, but includes seven plies in accordance with DOT regulations. FIG. 2 illustrates, in perspective, prior art airbill 20, commonly used to communicate sender, recipient and tracking information for packages. Both forms 10 and 20 are multi-ply forms arranged for tractor-feeding through a printer.

Figure 3:
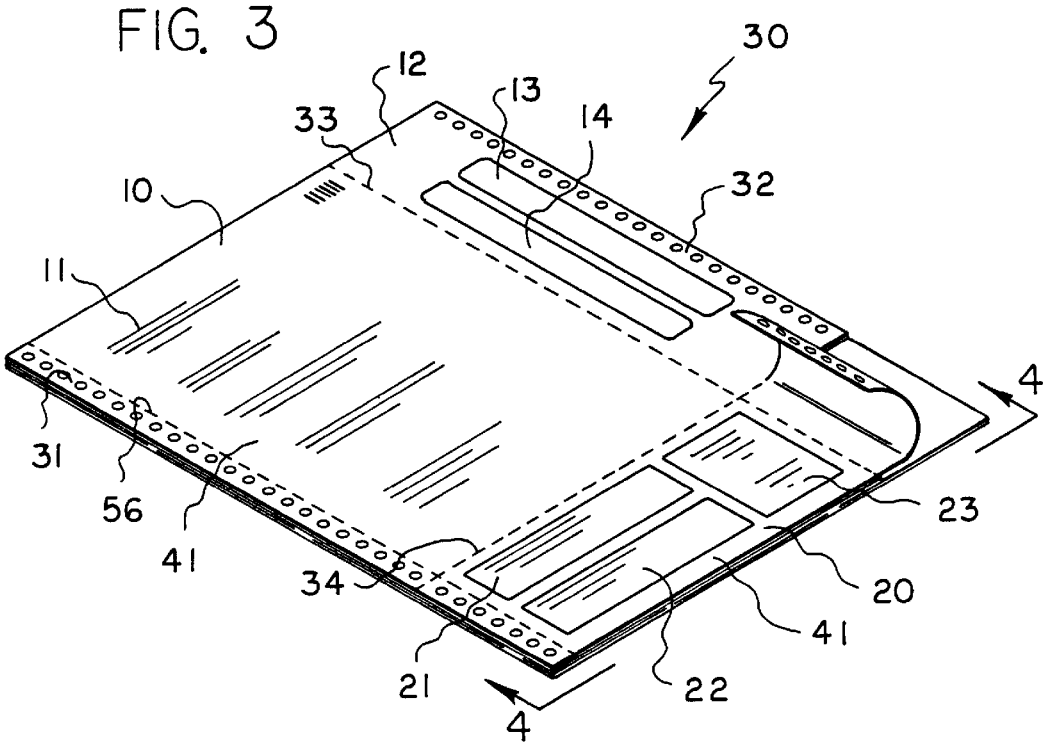
FIG. 3 is a perspective view of the combined airbill/federal drug testing custody and control form of the present invention.

A combined chain of custody(CCF)/airbill form 30 is shown in perspective in FIG. 3. The combined form comprises CCF 10 and airbill 20. The two form sections 10 and 20 are joined and detachably secured by perforation 34 which, in a preferred embodiment, perforates all plies of the combined form.

CCF 10 is shown to comprise first section 11 and second section 12. First section 11 is arranged to receive employer information, collector information, donor information, and chain of custody information. This information is imprinted on first or top ply 41 of the form, and reproduced on all of the underlying plies. The form uses well known carbonless techniques to reproduce the information on the underlying plies. Second section 12 includes bottle labels 13 and 14 which are used to label specimen containers (bottles). First and second sections 11 and 12 are detachably secured to one another by perforation 33.

Airbill 20 comprises a multi-ply form detachably secured to CCF 10 by perforation 34. First (top) ply 41 includes an area 21 where sender information is recorded, an area 22 where recipient information is recorded, and an area 23 where type of service, account and bar code tracking information is recorded. Similar to CCF 10, carbonless plies are used to reproduce the information on underlying plies. The airbill also includes an adhesive label on an underlying ply which is peeled off and affixed to the package during shipping.

Combined form 30 is arranged for tractor feeding through a printer, and includes tractor feed strips 31 and 32 for this purpose. The form is detachably secured to tractor feed strip 31 by perforation 51.

Figure 4:
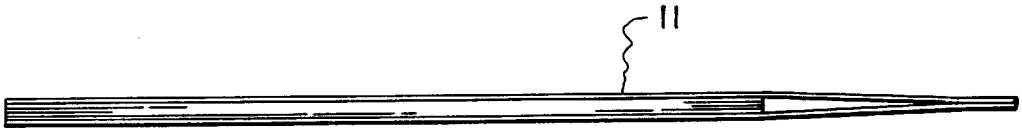
FIG. 4 is an end view of the form shown in FIG. 3, taken generally along line 4—4 in FIG. 3.

FIG. 4 is an end view of the combined form shown in FIG. 3, taken generally along line 4—4 in FIG. 3. As viewed from the perspective of one facing the end of the form in FIG. 4, it is seen that the form contains multiple plies (seven) to the left of perforation 33, but only two plies (the top and bottom plies) to the right of the perforation.

Figure 5:
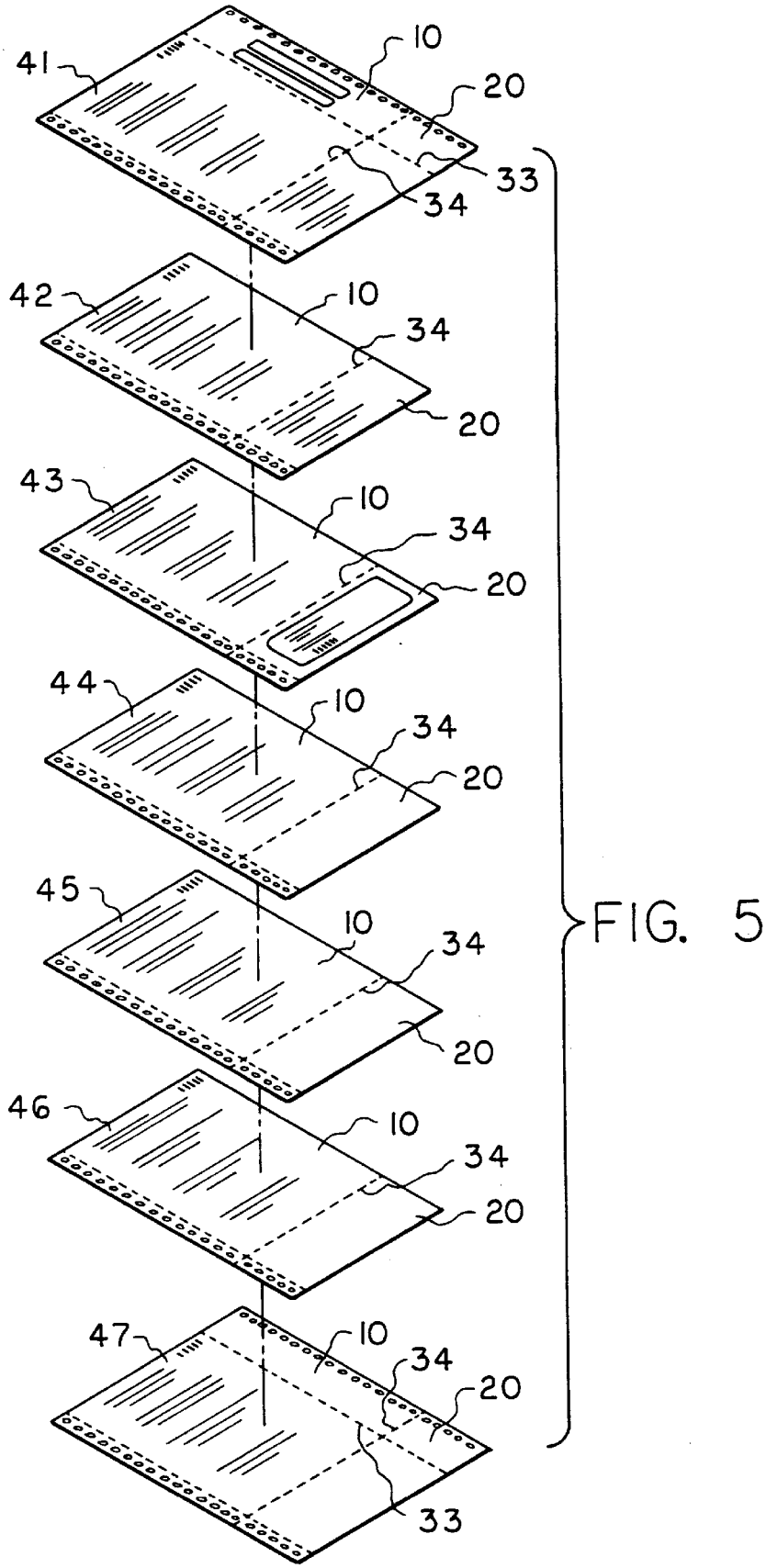
FIG. 5 is an exploded view of the form shown in FIG. 3.

Combined form 30 is shown in exploded view in FIG. 5. The form is shown as comprising seven plies 41–47, respectively. As described previously, all seven plies are used for the CCF, whereas only plies 41, 42 and 43 are used for the airbill. In the preferred embodiment shown, the bottle labels 13 and 14 of the CCF are secured to top ply 41, whereas airbill label 61 (identified in FIG. 9) is secured to third ply 43. Again, due to the carbonless copy nature of the individual plies, information recorded in section 11 of CCF part 10 and on airbill 20 is transferred to all of the underlying plies.

Figure 6:
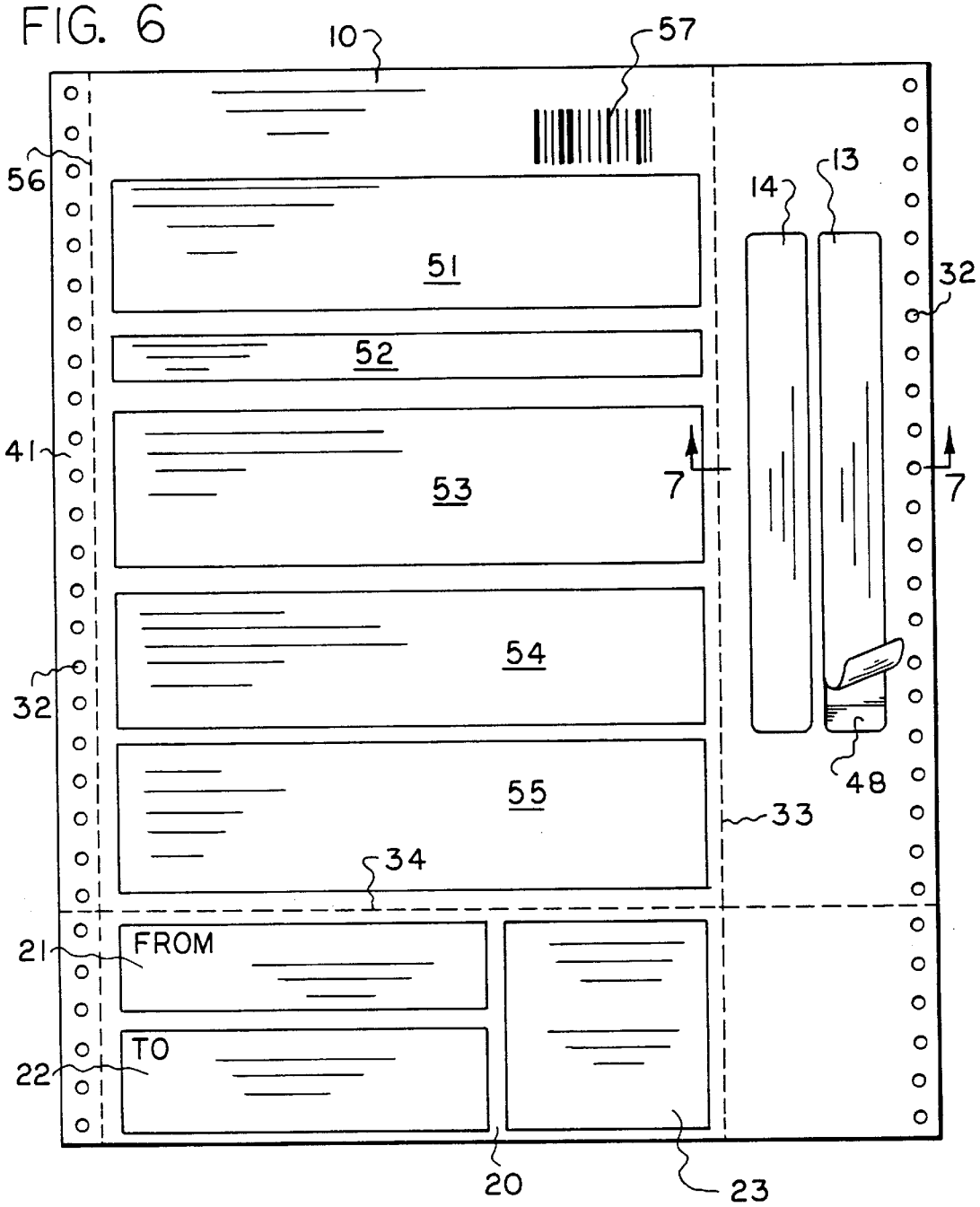
FIG. 6 is a plan view of the first or top ply of the form shown in FIGS. 3 and 5.

Top ply 41 is shown in plan view in FIG. 6. CCF 10 includes a bar code 57, and sections 51–55 for recording various information. Sections 51–55 are suitable for recording information required by the eight steps outlined in the Background of the Invention section of this patent for completing the CCF. CCF 10 also includes adhesive bottle labels 13 and 14 as described earlier. These labels are attached to bottles containing urine to be tested, and identify the specimens. Airbill 20 is shown to include section 21, 22 and 23 for recording sender, recipient, and other information, respectively. Section 23 is used to record the airbill number, customer account number and level of service required (i.e., next day, two day delivery, etc.).

Figure 7:
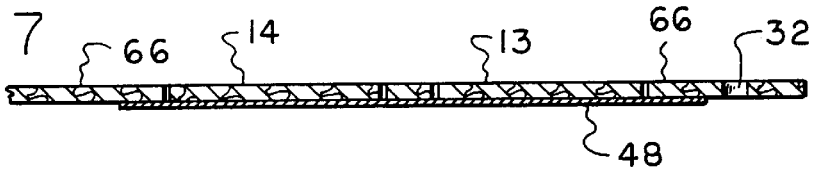
FIG. 7 is a fragmentary cross-sectional view of the top ply of the form taken generally along line 7—7 in FIG. 6.

Labels 13 and 14 are shown in fragmentary cross-sectional view in FIG. 7, taken generally along line 7—7 in FIG. 6. As shown in the drawing, labels 13 and 14 adhere to "blow-on" liner 48 secured to the underside of section 66 of top ply 41. Although in this embodiment, a blow-on liner is used, it should be appreciated that the adhesive labels could be mounted to a liner sheet which comprises a ply of the form. Also, it is not critical that the labels be secured to the top ply, although it is preferred that the labels always be visible concurrently with the rest of the CCF.

Figure 8:
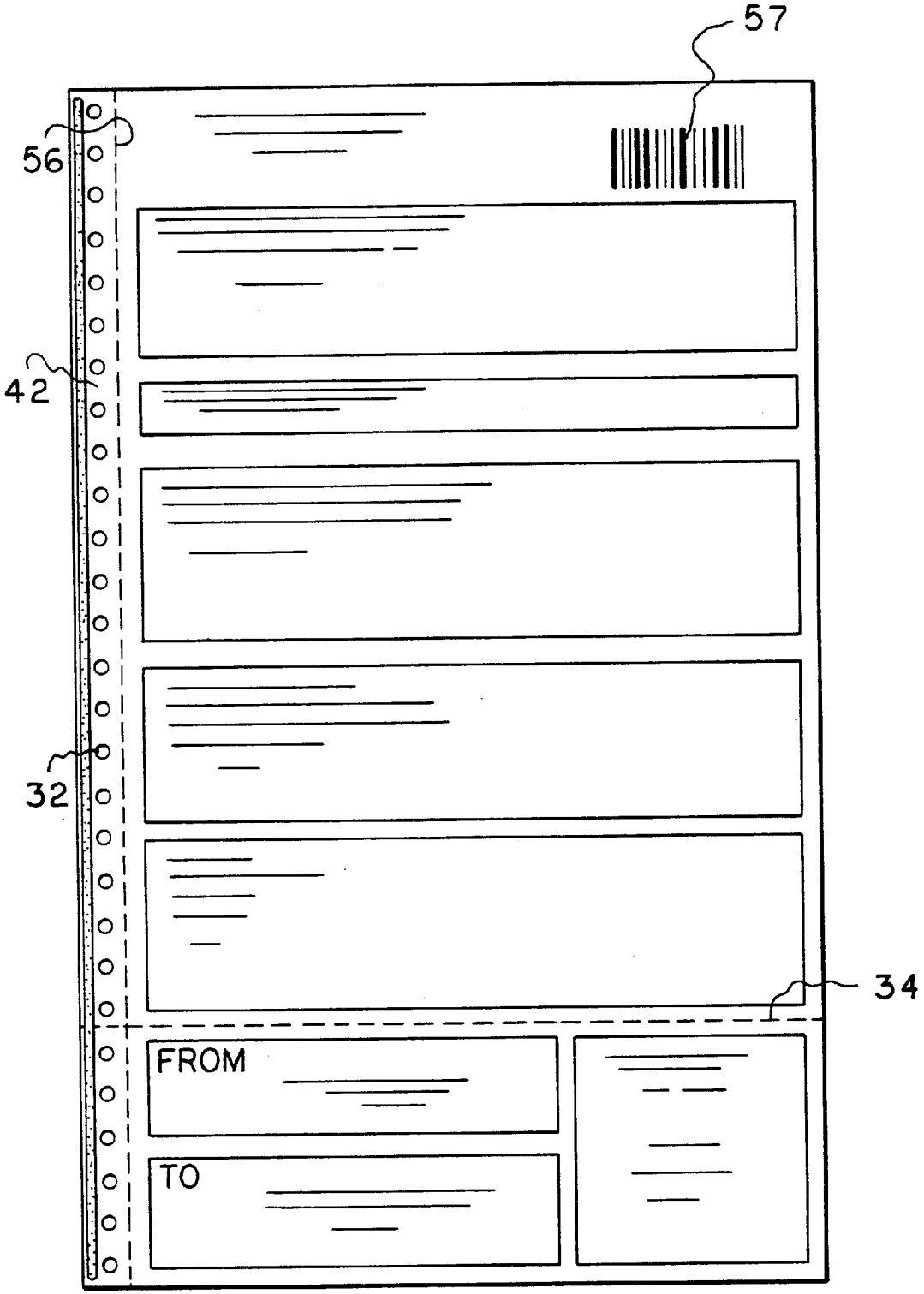
FIG. 8 is a plan view of the second ply of the form shown in FIGS. 3 and 5.

FIG. 8 illustrates second ply 42 of form 30 in plan view. FIG. 9 illustrates third ply 43 of form 30 in plan view. This ply includes airbill label 61 secured to blow-on liner 62. Liner 62 is secured to the underside of ply 43 as shown in fragmentary cross-sectional view in FIG. 10, a view taken generally along line 10—10 in FIG. 9. Label 61 also includes bar code 63 used for tracking and billing purposes. Bar code 63 may or may not be identical and carry the same coded information as bar code 57. Label 61 is also shown in cross-sectional view in FIG. 11, a fragmentary cross-sectional view taken generally along line 11—11 in FIG. 9.

Figure 13:
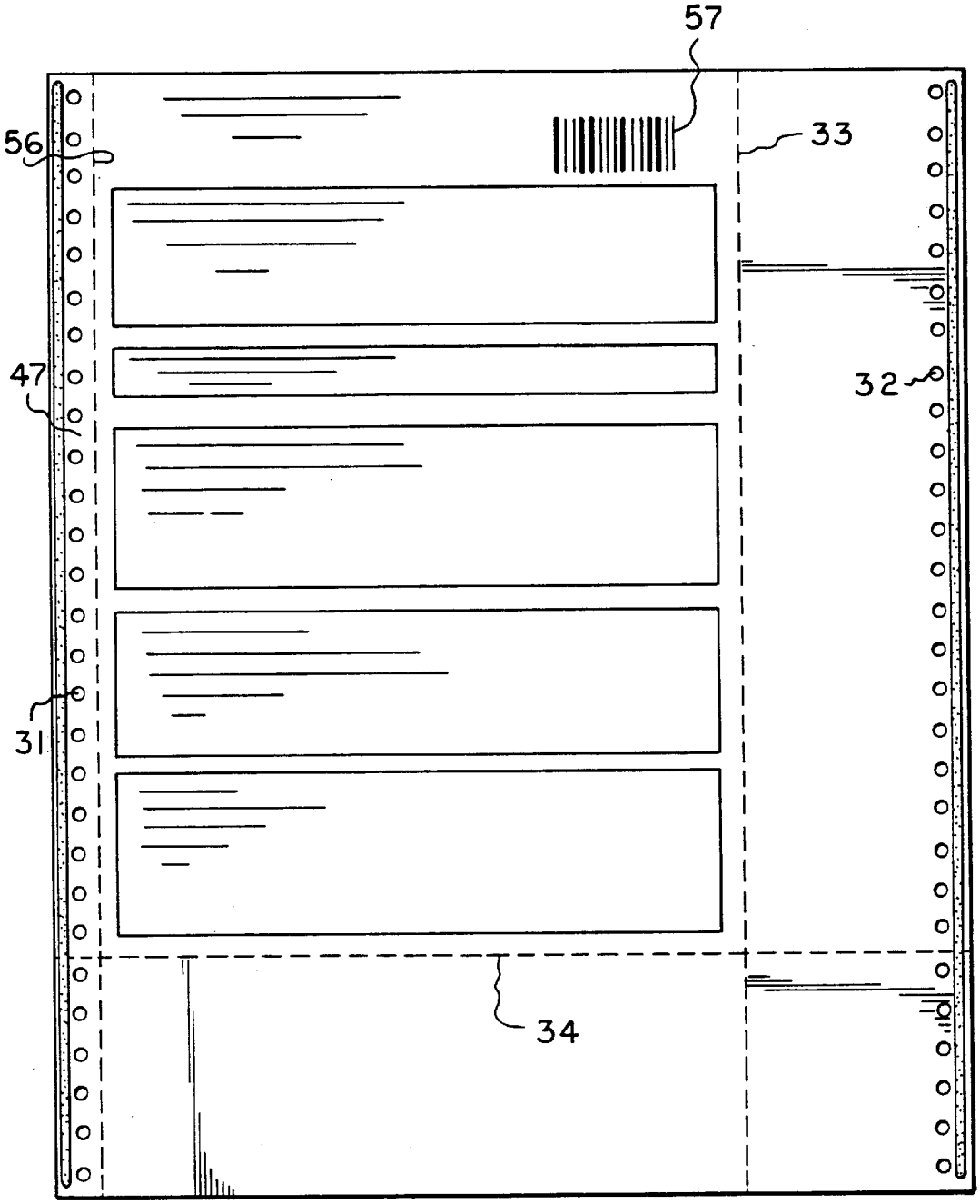

Plies 44–46 (the fourth-sixth layers) of form 30 are identical, and are represented in plan view in FIG. 12. Note that the airbill section is blank in this view as only the first three plies of the form are used for the airbill in this embodiment. Finally, the seventh, or bottom, ply 47 is illustrated in plan view in FIG. 13. Like the top ply, the bottom ply includes a section to the right of perforation 33, containing tractor feed strip 32. The top and bottom plies contain tractor feed strips on each side of the form to accommodate feeding the web of form segments through a printer. It should be appreciated that, although only a single form 30 has been illustrated and described, in practice form 30 would be detachably secured by perforations to a plurality of identical forms in a web.

While the present invention has been described with respect to what is presently considered to be the preferred embodiments, it is understood that the invention is not limited to the disclosed embodiments. The present invention is intended to cover various modifications and equivalent arrangements included within the spirit and scope of the appended claims.

What is claimed is:

1. A multi-ply business form, comprising:

a custody and control section comprising a first part having a plurality of color-coded plies for recording information required by federal drug testing regulations, and a second part having at least one label for labeling a container of body fluid specimens to be tested; and, an airbill section detachably secured to said custody and control section.

2. A multi-ply business form as recited in claim 1 wherein said airbill section comprises three plies.

3. A multi-ply business form as recited in claim 1 wherein said plurality of color-coded plies in said custody and control section comprise said three plies in said airbill section.

4. A multi-ply business form as recited in claim 3 wherein said airbill section comprises a first part for recording information about a sender and a recipient of said container, and a second part including a label for recording information about said sender and said recipient, said label arranged to be secured to said container.

5. A multi-ply business form as recited in claim 1 wherein said at least one label for labeling a container of body fluid specimens to be tested is an adhesive-backed label.

6. A multi-ply business form as recited in claim 4 wherein said airbill second part label for recording information about said sender and said recipient is adhesive-backed.

7. A multi-ply business form as recited in claim 4 wherein one of the plies of said business form includes said label for labeling a container of body fluid specimens to be tested, and a second and different ply includes said airbill label for recording information about said sender and said recipient.

8. A multi-ply business form as recited in claim 3 wherein three plies are used both for said first part of the custody and control section and said first part of the airbill section, and four additional plies are used only for the first part of the custody and control section.

9. A multi-ply business form as recited in claim 1 wherein said custody and control section section and said airbill section are detachably secured to one another by perforations in the plies of the multi-ply form.

10. A multi-ply business form as recited in claim 1, wherein a first ply of said first part of said custody and control section of said form is white in color, a second ply is white in color, a third ply is white in color, a fourth ply is pink in color, a fifth ply is green in color, a sixth ply is yellow in color, and a seventh ply is blue in color.

11. A multi-ply business form as recited in claim 1 wherein said first and second parts of said custody and control section of said form are detachably secured to one another.

12. A multi-ply business form as recited in claim 5 wherein said at least one adhesive-backed label for labeling a container of body fluid specimens to be tested is detachably secured to a liner that comprises one of the plies of the first part of the custody and control section of said form.

13. A multi-ply business form as recited in claim 5 wherein said at least one adhesive-backed label for labeling a container of body fluid specimens to be tested is detachably secured to a liner secured to one of the plies of the first part of the custody and control section of said form.

14. A multi-ply business form as recited in claim 6 wherein said at least one adhesive-backed airbill second part label for recording information about said sender and said reipient is secured to a liner that comprises one of the plies of the airbill section of the form.

15. A multi-ply business form as recited in claim 6 wherein said at least one adhesive-backed airbill second part label for recording information about said sender and said recipient is secured to a liner secured to one of the plies of the second part of the airbill section of the form.

16. A multi-ply business form, comprising:

a custody and control section comprising a first part having a plurality of color-coded plies for recording information required by federal drug testing regulations; and, an airbill section detachably secured to said custody and control section.

* * * * *